US005957322A

United States Patent [19]

Pugh

[11] Patent Number: 5,957,322

[45] Date of Patent: Sep. 28, 1999

[54] BARREL STORAGE UNIT

[76] Inventor: Dana Pugh, R.R.#2 Harstone Road, Kakabeka Falls, Ontario, Canada, P0T 1W0

[21] Appl. No.: 09/060,247

[22] Filed: Apr. 15, 1998

[51] Int. Cl.[6] ..... B65D 21/02

[52] U.S. Cl. ..... 220/560.03; 220/571; 220/7; 220/4.16; 220/23.88

[58] Field of Search ..... 220/6, 7, 666, 220/4.28, 4.16, 4.17, 4.12, 1.5, 571, 23.88, 560.03, 23.86, 23.4, 23.83, 909, 908; 206/514

[56] References Cited

U.S. PATENT DOCUMENTS

| | | | |
|---|---|---|---|
| 2,952,379 | 9/1960 | Potter | 220/6 |
| 3,048,147 | 8/1962 | McKean | 220/6 |
| 3,514,007 | 5/1970 | Woods, Sr. | 220/23.88 |
| 5,030,033 | 7/1991 | Heintzelman et al. | 405/128 |
| 5,119,935 | 6/1992 | Stump et al. | 220/6 |
| 5,131,552 | 7/1992 | Falso | 220/23.4 |
| 5,249,699 | 10/1993 | Williams | 220/571 |
| 5,417,344 | 5/1995 | Wells et al. | 220/571 |
| 5,450,978 | 9/1995 | Crisp et al. | 220/560.03 |
| 5,515,987 | 5/1996 | Jacques et al. | 220/6 |
| 5,622,276 | 4/1997 | Simmons | 220/6 |
| 5,769,109 | 6/1998 | Stanton et al. | 220/571 |

FOREIGN PATENT DOCUMENTS

| | | |
|---|---|---|
| 1283062 | 4/1991 | Canada . |
| 2033986 | 7/1995 | Canada . |
| 2121541 | 10/1995 | Canada . |

OTHER PUBLICATIONS

Brochure "Mandate Protection, Safety, Code Compliance"—Enviro–Tec Inc. (5 pages).

*Primary Examiner*—Stephen Castellano
*Attorney, Agent, or Firm*—Adrian D. Battison; Murray E. Thrift

[57] ABSTRACT

A storage container for barrels of liquid such as fuel arranged on their sides has a rigid base which is rectangular in plan to define two side edges and two end edges and dimensioned in width between side edges to receive a length of a barrel lying on its side across the width and in length between the end edges to receive a plurality of barrels side by side. The base has a bottom closed wall and four upstanding walls each at a respective edge of the bottom wall so as to define a sump to receive liquid from one or more of the barrels in the event of leakage. Across the top of the base is a pair of straps and end flanges to allow rolling of the barrels across the base. The container has two side walls and two end walls. Both of the end walls being hinged at a bottom edge for movement to an open ramp position to allow the barrels to be rolled into and out of the container. A cover panel which can be moved from a flat collapsed condition in which the sides a folded down to an operating condition attached to and extending over the side walls at a height to receive the rolled barrels. A lock assembly including a hanging lug on the cover panel locks the end wall in the raised position.

9 Claims, 6 Drawing Sheets

BARREL STORAGE UNIT

This invention relates to a storage container for barrels.

BACKGROUND OF THE INVENTION

Barrels containing fuel and other liquids are often required for supplying fuel in remote locations. These barrels are those open to damage, tampering and theft and in the event of any leakage the liquid escapes and can therefore cause local contamination.

Many such liquids are of a hazardous nature and therefore is important to ensure that they are properly stored with little or no possibility for any leakage.

Enviro-Tec Inc. of Alberta, Canada provide a number of storage containers for receiving and protecting barrels. These containers are relatively large and complex and therefore are difficult to transport to remote locations.

It is one object of the present invention therefore, to provide an improved storage container which allows the storage of barrels that is of simple relatively light weight construction having collapsibility and easy transportation of the container to assist in storing barrels in remote locations.

SUMMARY OF THE INVENTION

According to one aspect of the invention there is provided a storage container for barrels of liquid comprising:

a rigid base which is rectangular in plan to define two side edges and two end edges and dimensioned in width between side edges to receive a length of a barrel lying on its side across the width and in length between the end edges to receive a plurality of barrels side by side;

the base having a bottom closed wall and four upstanding base walls each at a respective edge of the bottom wall so as to define a sump to receive liquid from one or more of the barrels in the event of leakage;

two side walls each of which can be moved from a flat collapsed condition to an operating condition upstanding from a respective side edge;

two end walls each of which can be moved from a flat collapsed condition to an operating condition upstanding from a respective end edge;

at least one of the end walls being movable to an open position to allow the barrels to be rolled into and out of the container;

a cover panel which can be moved from a flat collapsed condition to an operating condition attached to and extending over the side walls, the height of the side walls being arranged such that the cover panel is supported at a height sufficient to receive between the cover panel and the base the diameter of the barrels;

and a lock assembly for locking said at least one end wall in said upstanding position thereof.

Preferably said at least one of the end walls is movable to a ramp position inclined downwardly and outwardly from a top edge of the base wall at the respective end edge of the base to allow the barrels to roll over the end wall in the ramp position into and out of the container.

Preferably both end walls move to said ramp position.

Preferably said end walls are hinged to the base at bottom edges thereof for pivotal movement about a horizontal pivot axis at the base.

Preferably the lock assembly locks an upper edge of said one end wall to the cover panel.

Preferably the cover panel includes a downwardly depending tab which co-operates with a lock receptacle on the upper edge of said one end wall such that a padlock can be engaged through the tab to lock the lock receptacle against the tab.

Preferably each of the end walls includes a ventilation opening.

Preferably the ventilation opening comprises a gap between a top edge of the end wall and the cover panel.

Preferably said at least one end wall includes a portion of the lock assembly extending upwardly into the gap for engagement with the tab for the cover panel.

Preferably the cover panel includes an overhang portion extending beyond the end wall at the ventilation gap.

Preferably the base includes support surfaces thereon across the top of the base for supporting the barrels spaced upwardly from the bottom wall.

Preferably the support surface include a pair of strap members extending longitudinally of the base and parallel to the side edges of the base to support the peripheral wall of the barrels.

Preferably the support surfaces include a pair of upstanding flanges for engaging top and bottom rims of the barrel.

Preferably the base includes a pair of elongate longitudinal skid members along the underside of the bottom wall.

Preferably at least one of the side walls includes longitudinally extending opening therein to allow viewing of the ends of the barrels.

Preferably the side walls are bolted to the base and to the cover panel for disassembly therefrom so as to be laid flat on the base when disassembled.

Preferably the side walls and end walls are hinged to the base such that they can be folded inwardly over the base.

Preferably the end walls are arranged to fold flat onto the base and wherein the side walls are arranged such that one folds on top of the ends and the second folds on top of the first.

Preferably the cover panel is arranged so as to lie on top of the folded end walls and wherein there is provided clamp members for holding the cover panel to the base.

According to a second aspect of the invention there is provided a storage container for barrels of liquid comprising:

a rigid base which is rectangular in plan to define two side edges and two end edges and dimensioned in width between side edges to receive a length of a barrel lying on its side across the width and in length between the end edges to receive a plurality of barrels side by side;

the base having a bottom closed wall and four upstanding base walls each at a respective edge of the bottom wall so as to define a sump to receive liquid from one or more of the barrels in the event of leakage;

two side walls;

two end walls;

at least one of the end walls being movable to an open position to allow the barrels to be rolled into and out of the container wherein said at least one of the end walls is movable to a ramp position inclined downwardly and outwardly from a top edge of the base wall at the respective end edge of the base to allow the barrels to roll over the end wall in the ramp position into and out of the container;

a cover panel which can be moved from a flat collapsed condition to an operating condition attached to and extending over the side walls;

the height of the side walls being arranged such that the cover panel is supported at a height sufficient to receive between the cover panel and the base the diameter of the barrels;

and a lock assembly for locking said at least one end wall in said upstanding position thereof.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

The container comprises a rigid base 10, two upstanding side walls 11 and 12 and two upstanding end walls 13 and 14. On top of the upstanding side walls is mounted a generally horizontal cover panel 15.

Figure 1:
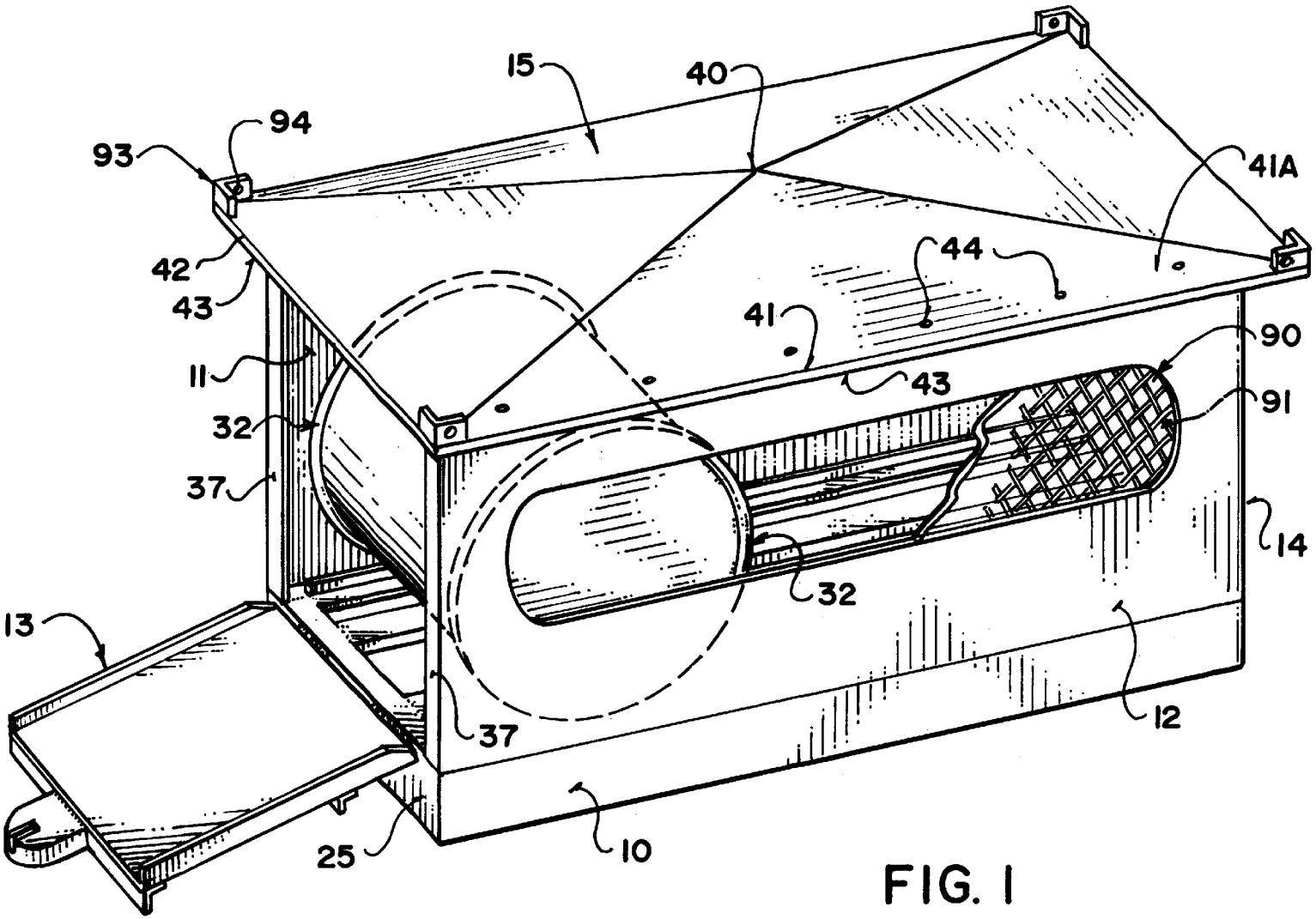
FIG. 1 is an isometric view of the container according to the present invention.

The container is designed to receive a plurality of barrels arranged on their side with the ends of the barrel adjacent the side walls 11 and 12. Thus the width of the base is slightly greater than the length of the barrel and the height of the side walls is slightly greater than the diameter of the barrels. The barrels are thus arranged side by side as shown in FIG. 1 and the container is designed to receive a number of barrels so that the length of the container between the end walls is equal to or slightly greater than the diameter of the plurality of the barrels and in the example shown there are three such barrels although the number of barrels can be increased or decreased in accordance with requirements.

Figure 2:
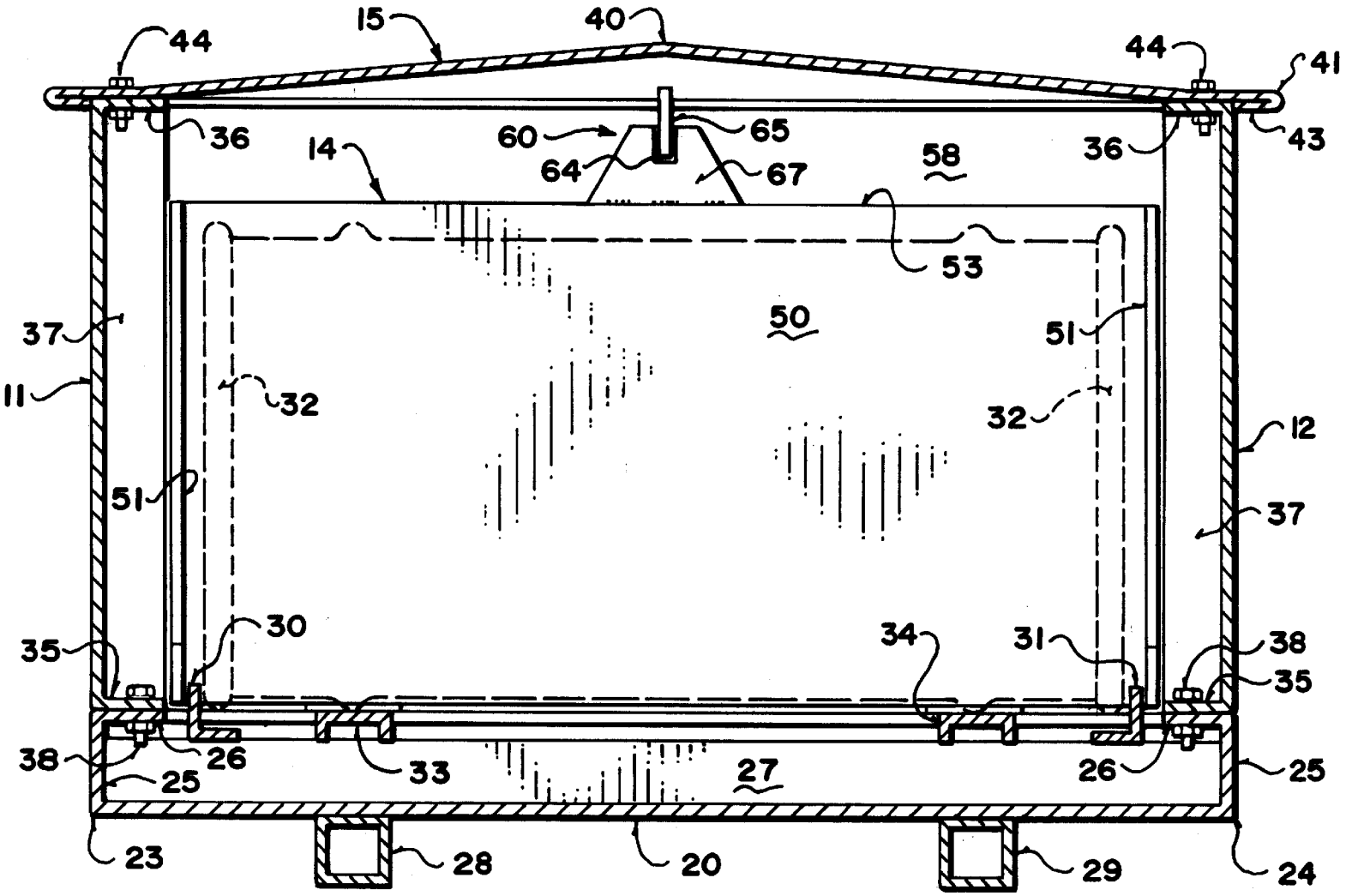
FIG. 2 is a vertical cross sectional view through the container of FIG. 1.
Figure 4:
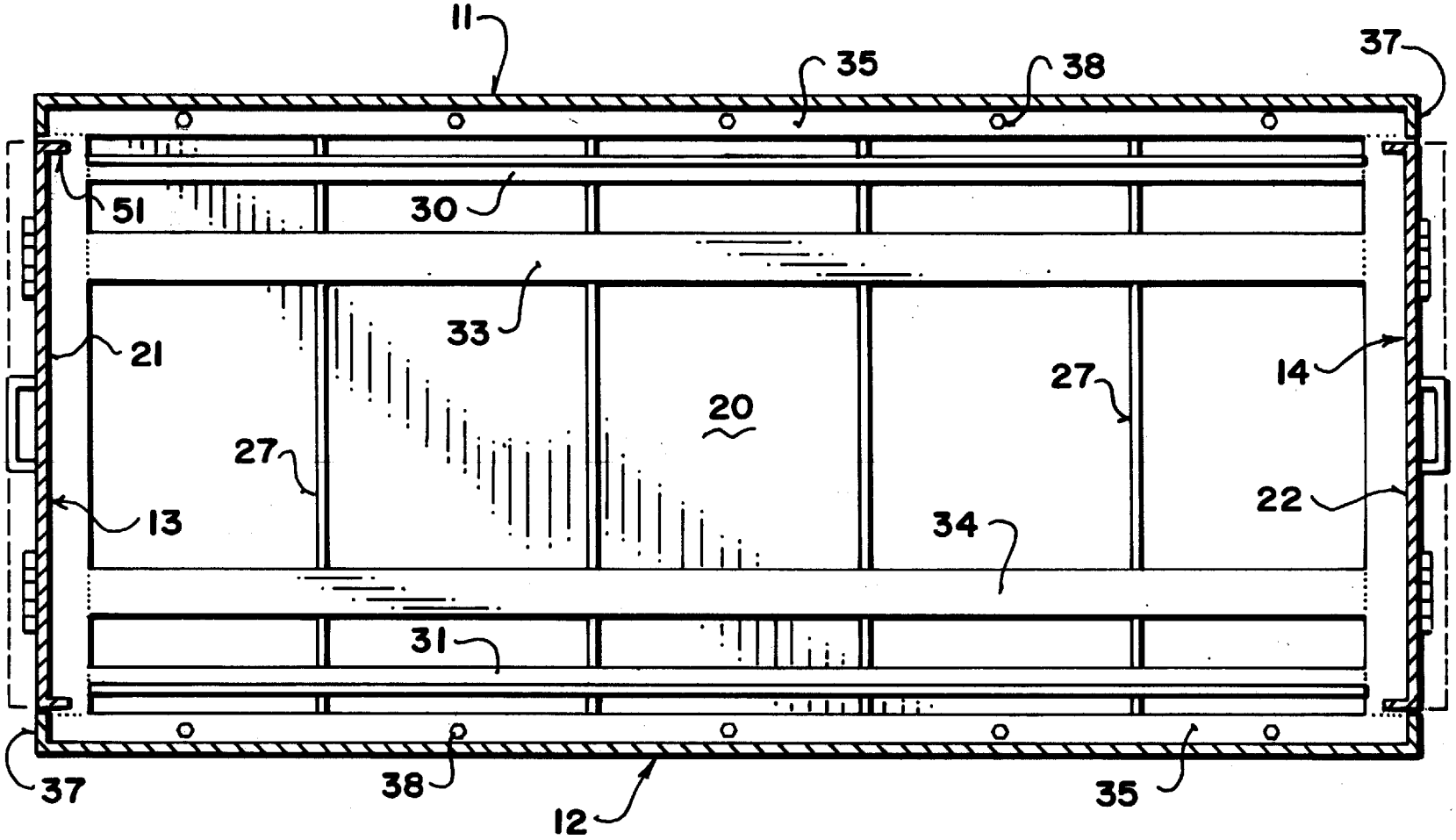
FIG. 4 is a horizontal cross-sectional view through the container of FIG. 1.

As best shown in FIGS. 2 and 4, the base comprises a closed bottom wall 20 which extends from end edges 21 and 22 of the bottom wall to side edges 23 and 24 of the bottom wall. The bottom wall thus has the same longitudinal and transverse dimensions as the base to accommodate the barrels as previously described. At each of the end edges and each of the side edges is provided an upstanding base wall 25 which is welded to the respective edge eof the bottom wall 20.

At the top of the base wall is provided an inturned flange 26 which is parallel to the bottom wall 20. A plurality of cross members 27 parallel to the end edges 21 and 22 and the base walls at those end edges extend across the base and are welded to the bottom wall 20 and to the base wall 25 at the side edges 23 and 24 so as to form a rigid rectangular construction stiffened by the cross members 27.

Underneath the bottom wall 20 is provided a pair of parallel skid members 28 and 29 each formed from a rectangular tubular member and extending substantially across the full length of the bottom surface for supporting the bottom surface away from the ground.

Along the length of the base is provided a pair of end guides 30 and 31 each comprising an angle iron with one web welded to the tops of the cross walls 27 and thus defining a flange standing upwardly from the base for engaging the ends of the barrel.

The barrels roll over a pair of support straps 33 and 34 which extend longitudinally of the base again welded to the tops of the cross walls 27. The end flanges 30 and 31 are spaced inwardly from the side edges 24 and 23. The support straps 33 and 34 are spaced inwardly from the end flanges 30 and 31 so as to receive the peripheral walls of the barrels to support the barrels in position above the base. The base thus forms a closed sump which is open at the top apart from the flanges 26, the end guides 30, 31 and the straps 33, 34. Thus any liquid escaping from one or more of the barrels can run downwardly into the hollow base for collection to prevent the liquid from escaping to the local ground with the possibility of contamination.

The side walls 11 and 12 are formed from sheet metal panels having an inturned bottom flange 35, an inturned top flange 36 and inturned end flanges 37. The bottom flange 35 is bolted to the top flange 26 of the base. The end flanges 37 are aligned with the upstanding end base walls 25. The side walls can thus be collapsed by removing the bolts 38 coupling the base flange 35 to the top flange 26. When removed the side walls can be folded flat over the top of the base. The top cover panel 15 comprises again a sheet metal panel which is shaped to define an upper most apex 40 at the centre of the panel and from that apex the panel is inclined downwardly and outwardly to side edges 41 and to end edges 42. At each side edge and end edge is provided a downturned shallow flange 43 providing a stiffening effect for the panel. The shallow inclination is just sufficient to allow shedding of water and to avoid pooling of water in a situation where the cover panel would be flat.

The side edges 41 are folded back as indicated at 41A for extra stiffness and slightly overhang the side walls 11 and 12. Just inside the side edges is provided a series of holes which allow the roof panel to be bolted to the top flange 36 by bolts 44. The end edges 42 of the cover panel overhang the end flanges 37 by a greater distance which can be six inches or more to provide an increased water shedding effect at the ends of the container.

Figure 3:
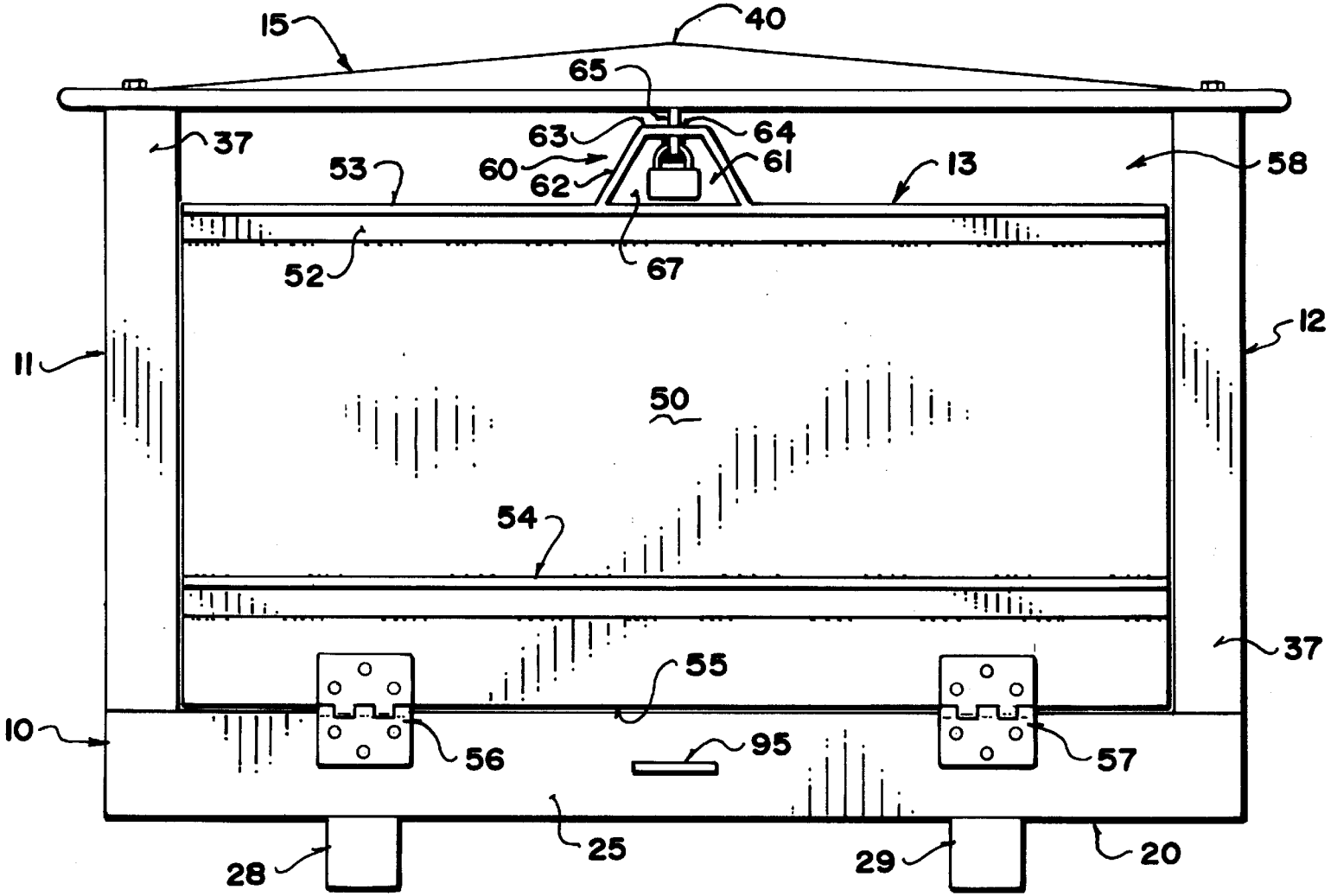
FIG. 3 is an end elevational view of the container of FIG. 1.
Figure 5:
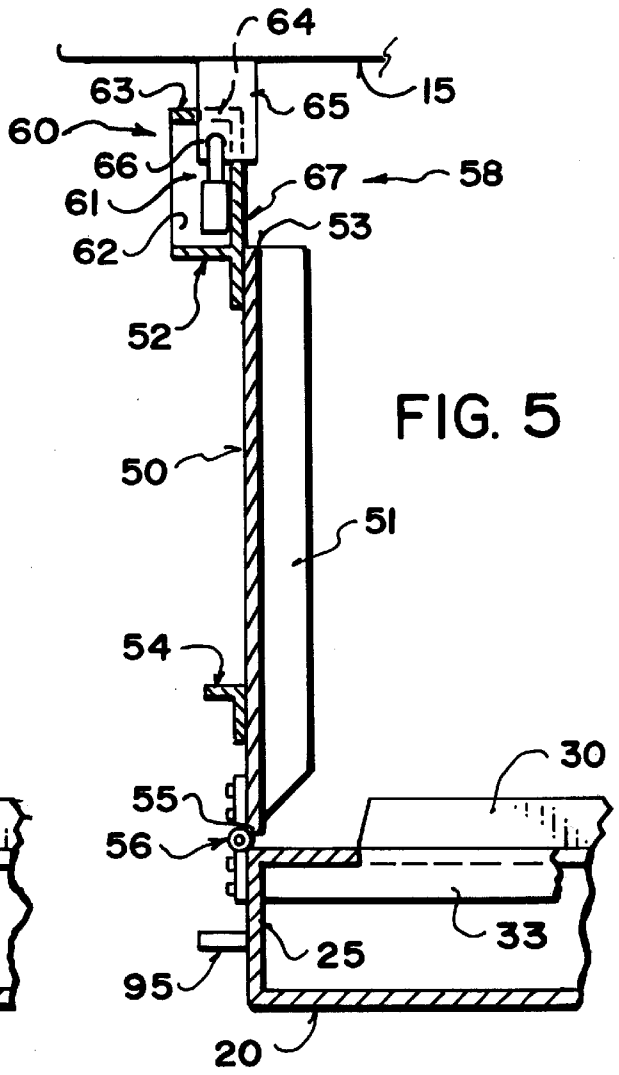
FIG. 5 is a vertical cross-sectional view through one end of the container of FIG. 1 showing the end wall in the raised closed position.
Figure 6:
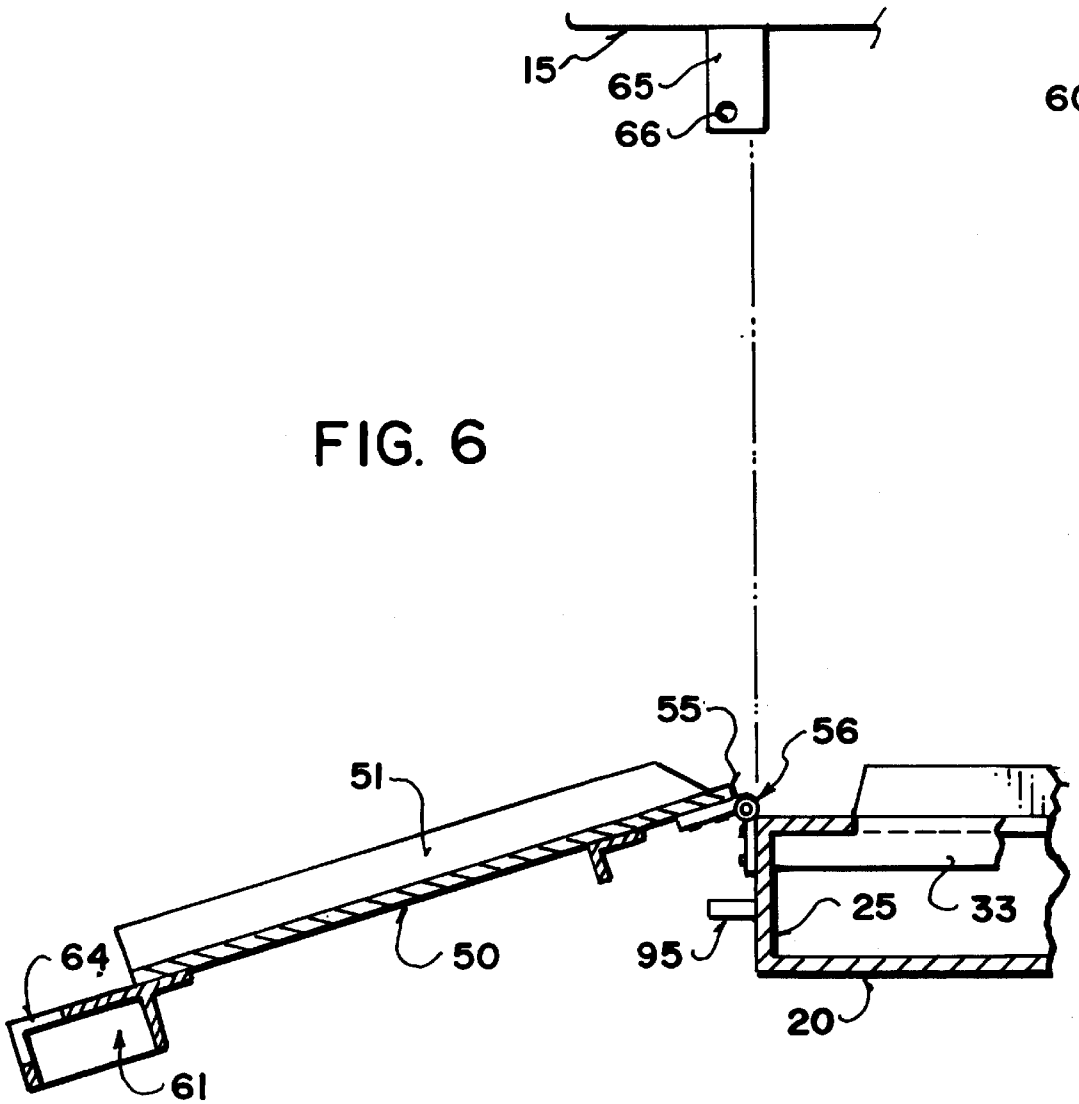
FIG. 6 is a cross sectional view similar to that of FIG. 5 showing the end wall in the lowered ramp position.

As best shown in FIGS. 3, 5 and 6, the end walls 13 and 14 again comprise sheet metal panels 50 with returned side flanges 51 which extend therefore into the container alongside or at the flanges 37 of the side walls. Each end wall is stiffened by a pair of angle irons including a top angle iron 52 across a top edge 53 of the panel and a bottom angle iron 54 spaced upwardly from a bottom edge 55 of the panel. The panel is hinged at its bottom edge 55 to the top edge of the end base wall 25 by a pair of heavy duty hinges 56 and 57 spaced apart across the width of the container. The hinges are bolted to the outside of the wall 25 and to the inside of the panel 50.

The top edge 53 is spaced downwardly from the top edge of the side walls 11 and 12 and thus is spaced downwardly from the cover panel leaving a space 58 across the width of the container between the flanges 37, the top edge 53 and the roof panel. This opening 58 acts as a ventilation opening to allow escape of moisture and vapour. In addition this opening acts as a release opening in the event of explosion to prevent the destruction of the container. The overhand from the cover panel however prevents the penetration of rain into this top opening.

A lock assembly 60 includes a lock receptacle 61 mounted on top of the angle iron 52 midway across the width of the end panel. The lock receptacle comprises an arched strap 62 welded to the top of the angle iron 52 and defining a horizontal top strap portion 63. A slot 64 in the top strap portion 63 receives a vertical tab 65 welded to the cover panel and depending downwardly therefrom. The tab is formed a strip lying in a plane longitudinal of the container so that the narrow strip fits into the narrow slot 64 to provide a hole 66 in front of a back plate 67 of the lock receptacle.

Thus when the end panel is pivoted upwardly about the hinges 56, it can be locked in place in the raised position by engagement into the lock receptacle 61 onto the tab 65 so that the tab has the lowermost portion thereof projecting into the locked receptacle so that a padlock can be inserted within the locked receptacle through the holes 66.

As shown in FIG. 6, when released from the tab 65, the end panel can pivot downwardly to a position shown in FIG. 6 in which the flange 52 at the upper edge 53 rests upon the ground and thus the panel is inclined downwardly and outwardly from the top edge of the end base wall 25 to the ground to allow a barrel to roll over the ramp defined by the end panel into the container and onto the support surfaces within the container.

In the embodiment shown in FIGS. 1 through 6, the container is collapsed by unbolting the side walls from the base and from the cover panel so that these can be carried separately. This embodiment therefore can be carried by two persons for ready transportation in a truck or in light aircraft. This embodiment is therefore formed in a series of separate pieces which can be individually lifted and stowed in the transportation vehicle.

Figure 7:
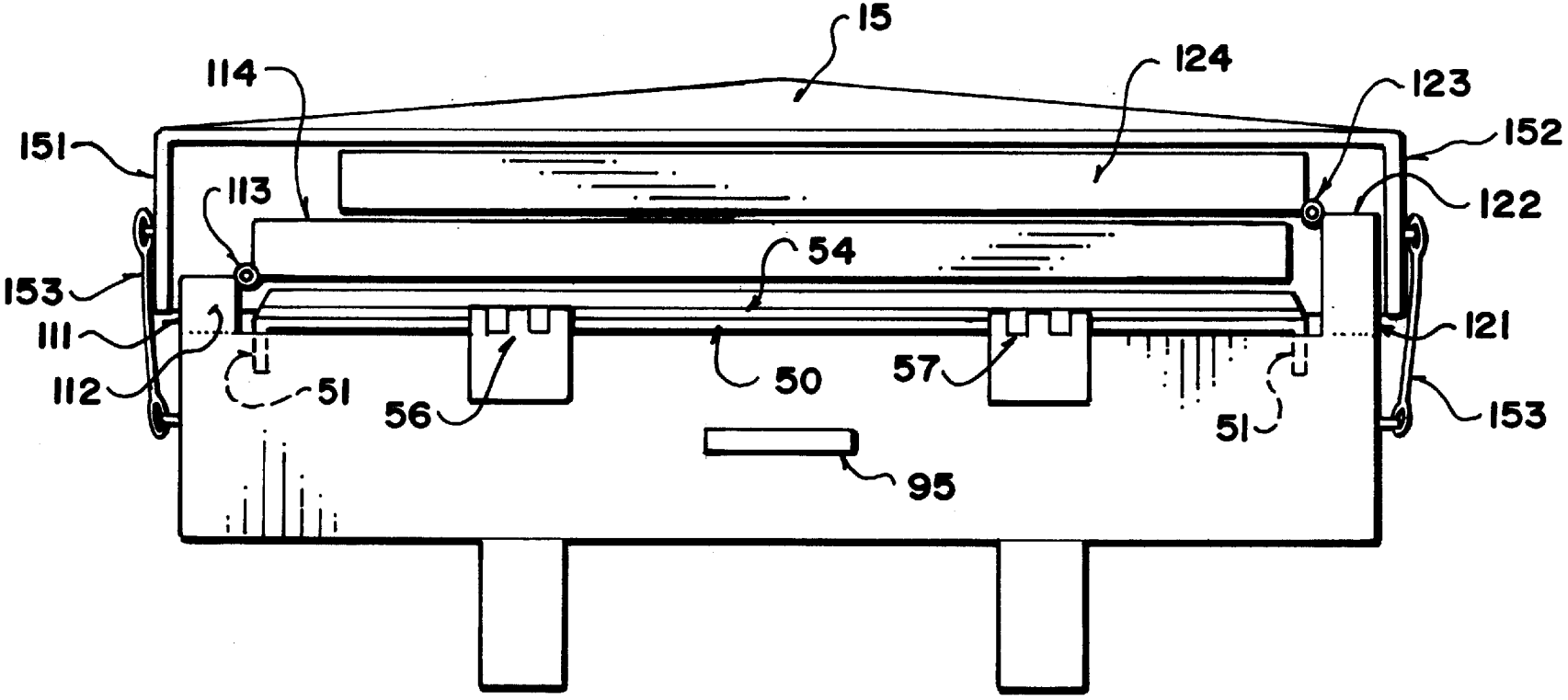
FIG. 7 is a vertical cross sectional view through a modified embodiment in which the side walls can fold and showing the container in a collapsed condition.

In an arrangement where it is desired to keep the elements integral for quicker erection, the arrangement as shown in FIG. 7 provides a hinging action of the side walls. This arrangement has the advantage that the elements are all kept integral so that there is no danger of loss of pieces. In this arrangement, therefore, the end walls 13 and 14 are folded inwardly so that the panel 50 lies flat across the base with the flanges 51 received within the area underneath the top surface of the base. The flanges 54 and 52 stand upwardly from the base.

An optional window 90 can be provided which is covered with a polycarbonate sheet to prevent penetration of rain and escape of fuel. A wire mesh screen 91 covering the sheet can be added for extra security.

Each corner of the cover panel carries a corner angle bracket 93 which is bolted or welded to the structure with sufficient strength to allow the container to be lifted by cables passing through holes 94 in the brackets. The brackets can also be used for engaging elements on the bottom of a next adjacent stacked container to allow stable stacking for transport either in the assembled condition as shown or in the folded condition as described hereinafter. The stacking elements can be provided by the skids 28, 29 if the skids are arranged along the side edges of the base. The skids can be formed of wood or similar non-metallic material to avoid sparks if the container is dragged over a stone or similar material. For the purpose of dragging, tow hooks 95 can be provided at both ends attached to the base.

In this embodiment the side wall 111 includes a stub side wall portion 112 standing upwardly from the base and permanently attached to the base. A hinge 113 connects an upper side wall portion 114 to the stub side wall portion allowing it to hinge inwardly to lie flat over the upstanding flanges 54 and 52 of the end wall portions. Similarly the side wall 121 includes a stub wall portion 122 and a hinge 123 connecting a main portion 124. The stub wall portion 112 is of less height than the stub wall portion 122 so that the main side wall portion 124 can fold flat over the top of the main side wall portion 114. The cover panel 15 in this embodiment includes downwturned side flanges 151 and 152 which are of increased length so as to cover the stacked folded side walls with a bottom edge of the downturned flange extending to a position closely adjacent the base. This allows a latch 152 to be connected between the flanges 151, 152 and the base to hold the assembly in fixed position when collapsed for transportation.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

I claim:

1. A combination of a plurality of storage barrels for liquid and a storage container therefor comprising:

a plurality of storage barrels each having a cylindrical peripheral wall defining a diameter of the barrel and a pair of generally parallel circular end walls spaced apart by a length of the barrel;

and a storage container comprising:

a rigid base which is rectangular in plan to define two side edges and two end edges and dimensioned in width between side edges to receive therebetween the length of the barrels each lying on its side across the width and in length between the end edges to receive the plurality of barrels side by side;

the base having a bottom closed wall and four upstanding base walls each at a respective edge of the bottom wall so as to define a sump to receive liquid from one or more of the barrels in the event of leakage;

two side walls each of which can be moved from a flat collapsed condition on the base to an operating condition upstanding from a respective side edge;

a cover panel which can be moved from a flat collapsed condition on the base to an operating condition attached to and extending over the side walls;

the side walls, the base and the cover panel being arranged such that, when assembled to the operating condition, the side walls, the base and the cover panel are fixed together to form a free standing, independent, rigid container from which the barrels can be removed only from at least one end;

the container so formed being dimensioned such that the container has a height arranged to just receive between the cover panel and the base the diameter of the barrels;

two end walls each of which can be moved from a flat collapsed condition on the base to an operating condition upstanding from a respective end edge to close the container;

at least one of the end walls being movable, with the walls assembled to the operating condition to receive the barrels, to an open position to allow the barrels to be rolled into and out of the container through the respective end;

and a lock assembly including a padlock for locking said at least one end wall in a closed position thereof so as to prevent unauthorized removal of the barrels from the container.

2. The combination according to claim 1, wherein the cover panel includes a downwardly depending tab which co-operates with a lock receptacle on the upper edge of said one end wall such that the padlock can be engaged through the tab to lock the lock receptacle against the tab.

3. The combination according to claim 1, wherein at least one of the side walls includes longitudinally extending opening therein to allow viewing of the ends of each of the barrels.

4. A combination of a plurality of storage barrels for liquid and a storage container therefor comprising:

a plurality of storage barrels each having a cylindrical peripheral wall defining a diameter of the barrel and a pair of generally parallel circular end walls spaced apart by a length of the barrel;

and a storage container comprising:

a rigid base which is rectangular in plan to define two side edges and two end edges and dimensioned in width between side edges to receive the length of the barrels each lying on its side across the width and in length between the end edges to receive the plurality of barrels side by side;

the base having a bottom closed wall and four upstanding base walls each at a respective edge of the bottom wall so as to define a sump to receive liquid from one or more of the barrels in the event of leakage;

two side walls;

a cover panel;

the side walls, the base and the cover panel being arranged such that, when assembled to an operating condition, the side walls, the base and the cover panel are fixed together to form a free standing, independent, rigid container from which the barrels can be removed only from at least one end;

the container so formed being dimensioned such that the container has a height arranged to just receive between the cover panel and the base the diameter of the barrels;

two end walls;

at least one of the end walls being mounted on the base for movement relative thereto between an upstanding closed position and an open position allowing movement of the barrels into and out of the container;

wherein at least one of the end walls includes a ventilation opening defined by a gap between a top edge of the end wall and the cover panel.

5. The combination according to claim 4, wherein said at least one end wall includes a portion of the lock assembly extending upwardly into the gap for engagement with a tab depending from the cover panel.

6. The combination according to claim 4 wherein the cover panel includes an overhang portion extending beyond the end wall at the ventilation gap.

7. A combination of a plurality of storage barrels for liquid and a storage container therefor comprising:

a plurality of storage barrels each having a cylindrical peripheral wall defining a diameter of the barrel and a pair of generally parallel circular end walls spaced apart by a length of the barrel;

and a storage container comprising:

a rigid base which is rectangular in plan to define two side edges and two end edges and dimensioned in width between side edges to receive the length of the barrels each lying on its side across the width and in length between the end edges to receive the plurality of barrels side by side;

the base having a bottom closed wall and four upstanding base walls each at a respective edge of the bottom wall so as to define a sump to receive liquid from one or more of the barrels in the event of leakage;

two side walls;

a cover panel;

the side walls, the base and the cover panel being arranged such that, when assembled to an operating condition, the side walls, the base and the cover panel are fixed together to form a free standing, independent, rigid container from which the barrels can be removed only from at least one end;

the container so formed being dimensioned such that the container has a height arranged to just receive between the cover panel and the base the diameter of the barrels;

two end walls;

at least one of the end walls being mounted on the base for movement relative thereto between an upstanding closed position and an open position allowing movement of the barrels into and out of the container;

wherein the base includes support surfaces thereon extending longitudinally of the base at a height thereon substantially coplanar with the top of the base walls engaging and supporting the peripheral walls of the barrels spaced upwardly from the bottom wall and out of the sump;

and wherein the base includes transversely spaced raised guide flanges thereon standing upwardly from the base above the top of the base walls and arranged at a required spacing so as to be in engagement with the end walls of the barrels for guiding the barrels in rolling movement along the base.

8. The combination according to claim 7, wherein said at least one of the end walls is mounted on the base for movement relative thereto between the upstanding closed position and a ramp position inclined downwardly and outwardly from a top edge of the base wall at the respective end edge of the base to allow the barrels to roll over the end wall in the ramp position onto and away from the support surfaces of the container.

9. The combination according to claim 7, wherein at least one of the side walls includes longitudinally extending opening therein to allow viewing of the ends of each of the barrels.

* * * * *